US007086379B2

(12) United States Patent
Blomenberg et al.

(10) Patent No.: US 7,086,379 B2
(45) Date of Patent: Aug. 8, 2006

(54) POWER CONTROL DEVICE AND METHOD FOR A MOTORCYCLE

(75) Inventors: Timothy Blomenberg, West Decatur, IN (US); David M. Boyles, Waukesha, WI (US); Daniel Hurda, Mequon, WI (US)

(73) Assignees: Buell Motorcycle Company, East Troy, WI (US); Kimball Electronics, Inc., Jasper, IN (US)

( * ) Notice: Subject to any disclaimer, the term of this patent is extended or adjusted under 35 U.S.C. 154(b) by 81 days.

(21) Appl. No.: 10/886,137

(22) Filed: Jul. 7, 2004

(65) Prior Publication Data

US 2006/0005808 A1 Jan. 12, 2006

(51) Int. Cl.

| | |
|---|---|
| ***F02D 9/02*** | (2006.01) |
| ***F02D 11/02*** | (2006.01) |
| ***F02D 11/04*** | (2006.01) |
| ***F02D 11/10*** | (2006.01) |

(52) U.S. Cl. ..... 123/399

(58) Field of Classification Search ..... 123/399
See application file for complete search history.

(56) References Cited

U.S. PATENT DOCUMENTS

| | | | | |
|---|---|---|---|---|
| 4,367,708 | A | 1/1983 | Nakamura et al. | |
| 4,524,843 | A | 6/1985 | Class et al. | |
| 4,611,561 | A | 9/1986 | Suyama | |
| 4,838,780 | A | 6/1989 | Yamagata et al. | |
| 4,887,684 | A | 12/1989 | King | |
| 5,002,032 | A * | 3/1991 | Kolberg | 123/399 |
| 5,076,231 | A * | 12/1991 | Buchl | 123/399 |
| 5,199,401 | A * | 4/1993 | O'Neil et al. | 123/342 |
| 5,447,133 | A * | 9/1995 | Kamio et al. | 123/396 |
| 6,423,914 | B1 | 7/2002 | Burnett | |
| 6,699,085 | B1 | 3/2004 | Hattori | |
| 6,701,890 | B1 * | 3/2004 | Suhre et al. | 123/350 |
| 2002/0139348 | A1 * | 10/2002 | Kuretake | 123/399 |
| 2004/0094123 | A1 * | 5/2004 | Takahashi et al. | 123/399 |

* cited by examiner

*Primary Examiner*—Erick R. Solis
(74) *Attorney, Agent, or Firm*—Michael Best & Friedrich LLP

(57) ABSTRACT

A power control device and method for a motorcycle. The power control device controls the power of the motorcycle engine in predetermined situations. The power control device controls the power output of the engine while maintaining an optimal air-to-fuel ratio to prevent backfires and misfires during combustion. In one embodiment, the power control device reduces the airflow to the engine by rotating a throttle valve. The amount of fuel delivered to the engine is also reduced corresponding to the position of the throttle valve. By reducing the amount of fuel delivered to the engine based upon the amount of airflow to the engine, the air-to-fuel ratio within the engine remains optimal for combustion. The throttle valve can be rotated by the operator and by the power control device. The position of the throttle plate and corresponding power output of the engine is controlled by the operator until overridden by the power control device.

31 Claims, 10 Drawing Sheets

POWER CONTROL DEVICE AND METHOD FOR A MOTORCYCLE

BACKGROUND

The power of a motorcycle engine is controlled in some situations by an engine control module that senses a variety of operating parameters and selectively controls the power of the motorcycle when several parameters fall within a predetermined range. Conventionally, the power is reduced by shutting off fuel to the engine or cutting out the spark. Although these techniques control the power, they also tend to induce lean running conditions, which ultimately cause increased noise emissions from the engine due to backfires and misfires.

SUMMARY OF THE INVENTION

The present invention is directed to a power control device and method of controlling a motorcycle engine. The power control device controls the power of the motorcycle engine in predetermined situations while maintaining optimal air-fuel ratios to prevent backfires and misfires during combustion.

In one embodiment, the power control device reduces the airflow to the engine by rotating a throttle plate within a throttle body. The amount of fuel delivered to the engine is also reduced corresponding to the position of the throttle plate. By reducing the amount of fuel delivered to the engine based upon the amount of airflow to the engine, combustion within the engine remains optimal.

In one embodiment, the throttle plate can be rotated by the operator and by the power control device. The position of the throttle plate and corresponding power output of the engine is controlled by the operator until overridden by the power control device. The power control device generally only overrides the operator's control during predetermined operating conditions of the motorcycle. When the power control device overrides the operator's control, the position of the throttle plate is determined by the power control device without moving a hand operated control used by the operator to control the power output.

These and other aspects of the present invention, together with the organization and operation thereof, will become apparent from the following detailed description of the invention when taken in conjunction with the accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

DESCRIPTION OF THE ILLUSTRATED EMBODIMENTS

Figure 1:
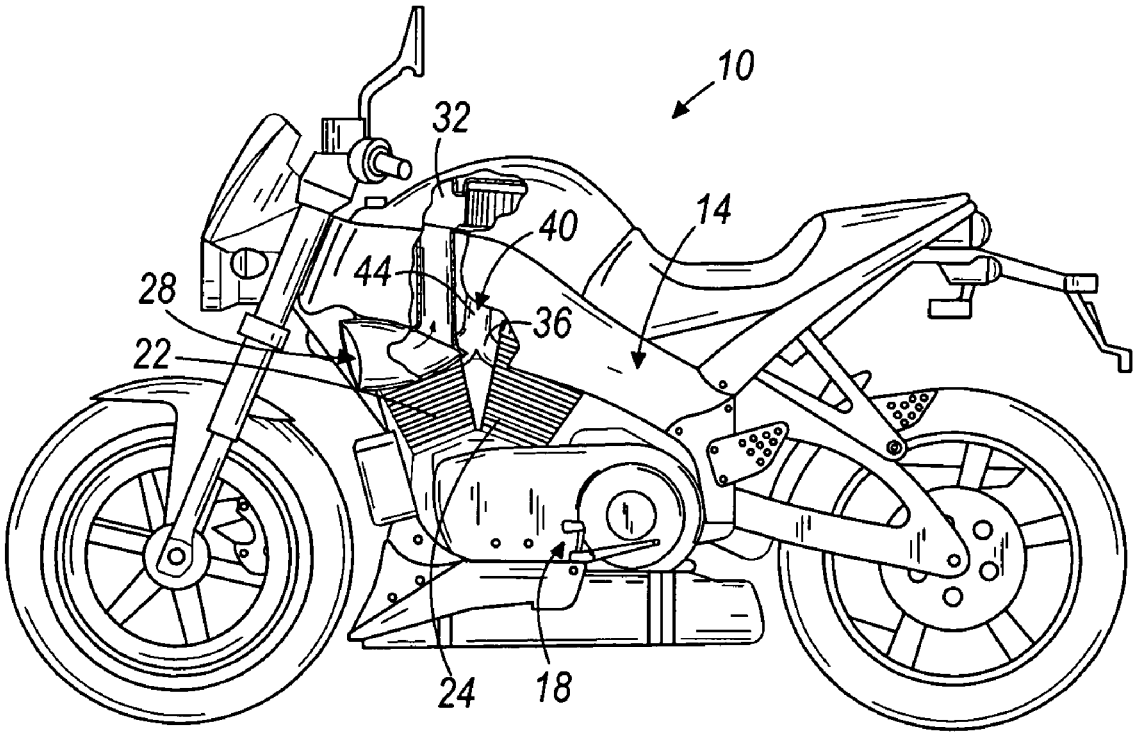
FIG. 1 is a side view of a motorcycle having an intake power control according to one embodiment of the present invention.

FIG. 1 illustrates a motorcycle 10 that includes a frame 14 and an engine 18 connected to the frame 14. The engine 18 is a V-twin style engine having a front cylinder 22 and a rear cylinder 24. The motorcycle 10 also includes a horizontally oriented air scoop 28 that collects air that is ultimately directed to the front and rear cylinders 22, 24 for combustion. Specifically, the collected air passes through an airbox 32 where the air is filtered before entering the air intake manifold 36 of the engine 18. The amount of air delivered to the cylinders 22, 24 is controlled by a throttle assembly 40 that is coupled to the air intake manifold 36.

Figure 2:
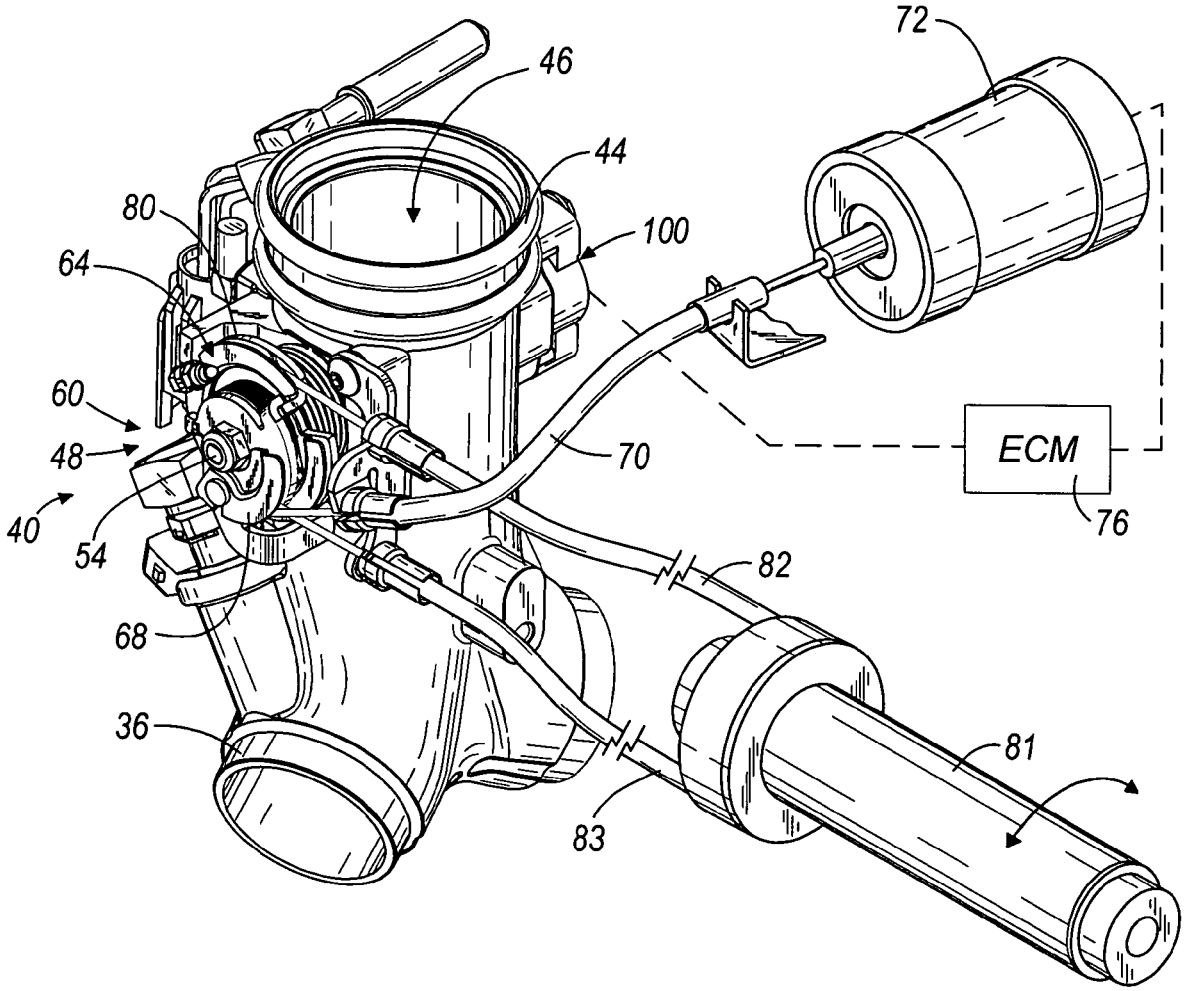
FIG. 2 is a perspective view of the intake power control illustrated in FIG. 1.
Figure 3:
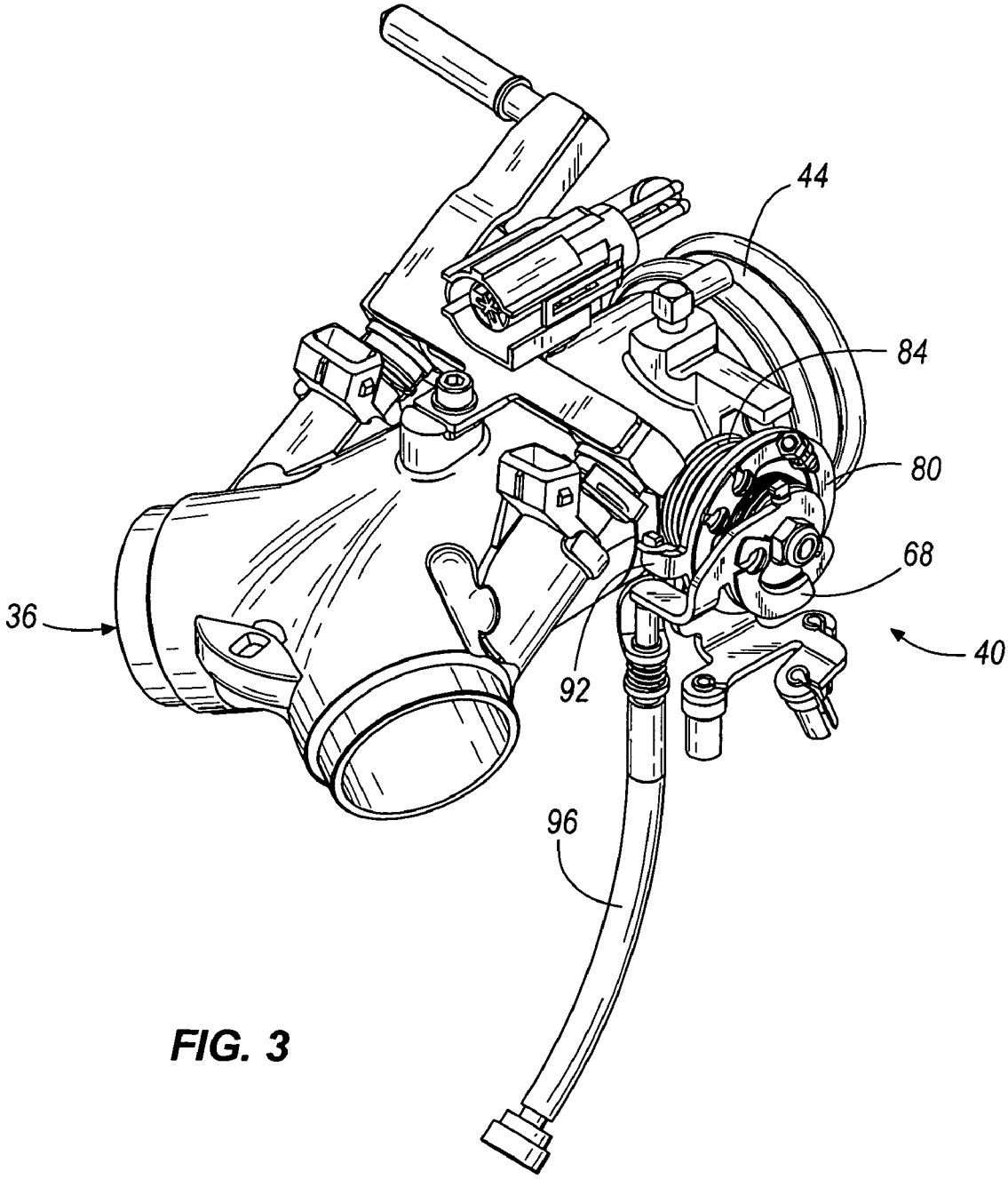
FIG. 3 is a perspective view of a portion of the intake power control illustrated in FIG. 2.
Figure 4:
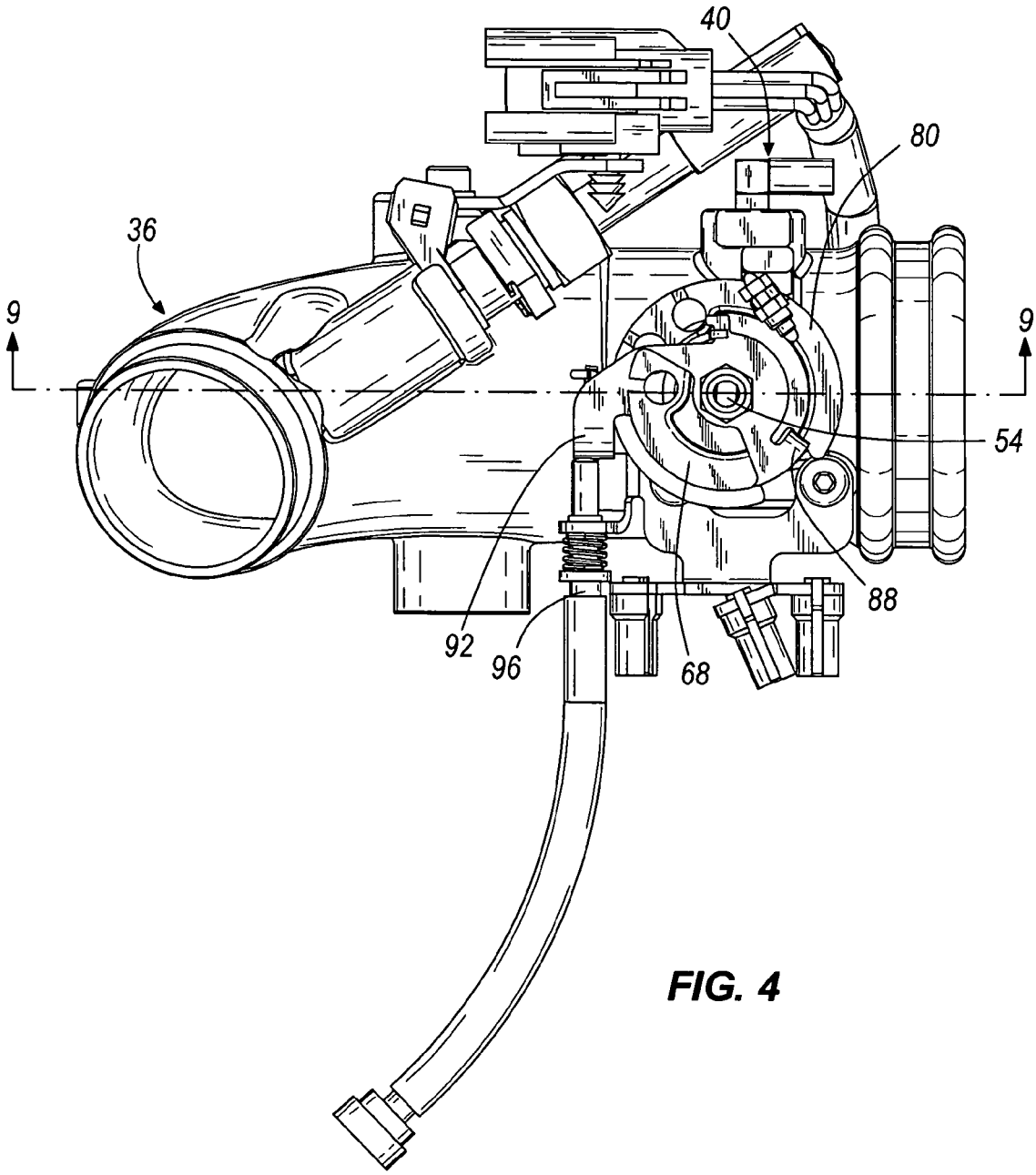
FIG. 4 is a side view of the portion of the intake power control shown in FIG. 3.
Figure 9:
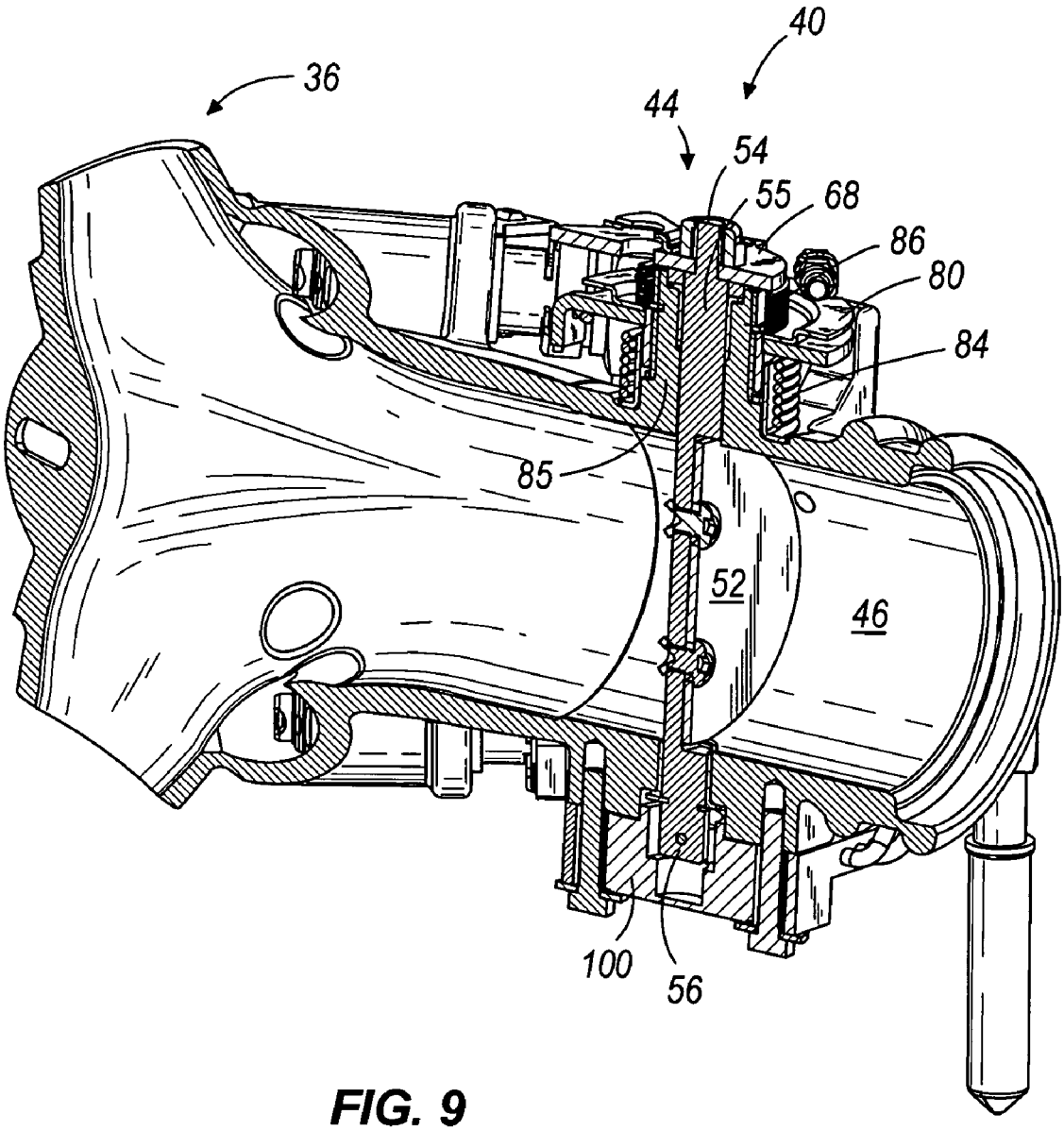
FIG. 9 is a perspective cross-sectional view taken along line 9—9 of FIG. 4.
Figure 10:
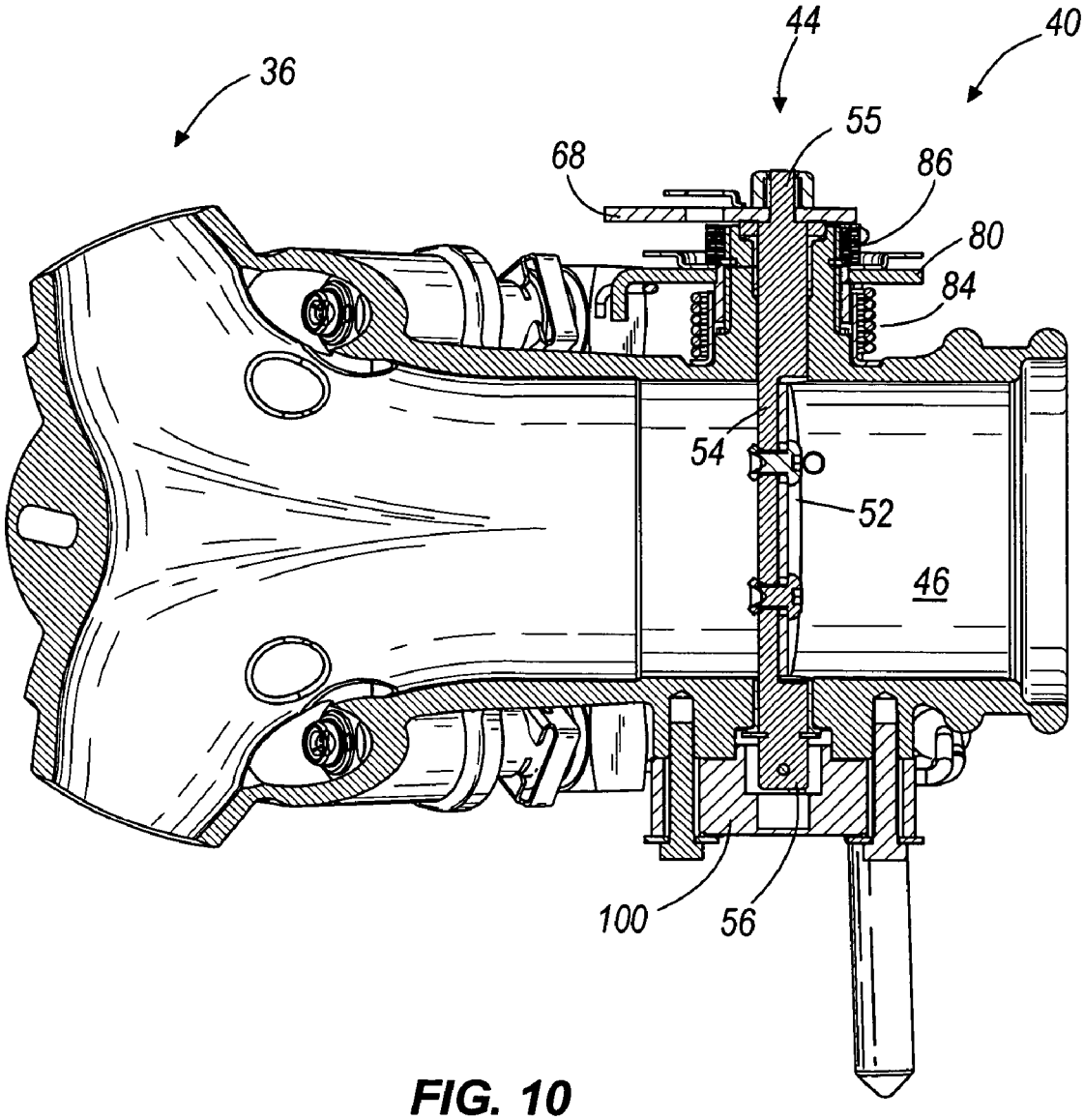
FIG. 10 is a side cross-sectional view taken along line 9—9 of FIG. 4.

As shown in FIGS. 2, 9, and 10, the throttle assembly 40 includes a throttle body 44 defining an air passage 46, a valve 48 positioned within the throttle body 44, and a control system coupled to the valve 48 to control the position of the valve 48 within the throttle body 44. The throttle body 44 is coupled to the manifold 36, and as such, the valve 48 controls the amount of airflow to the manifold 36.

Figure 5:
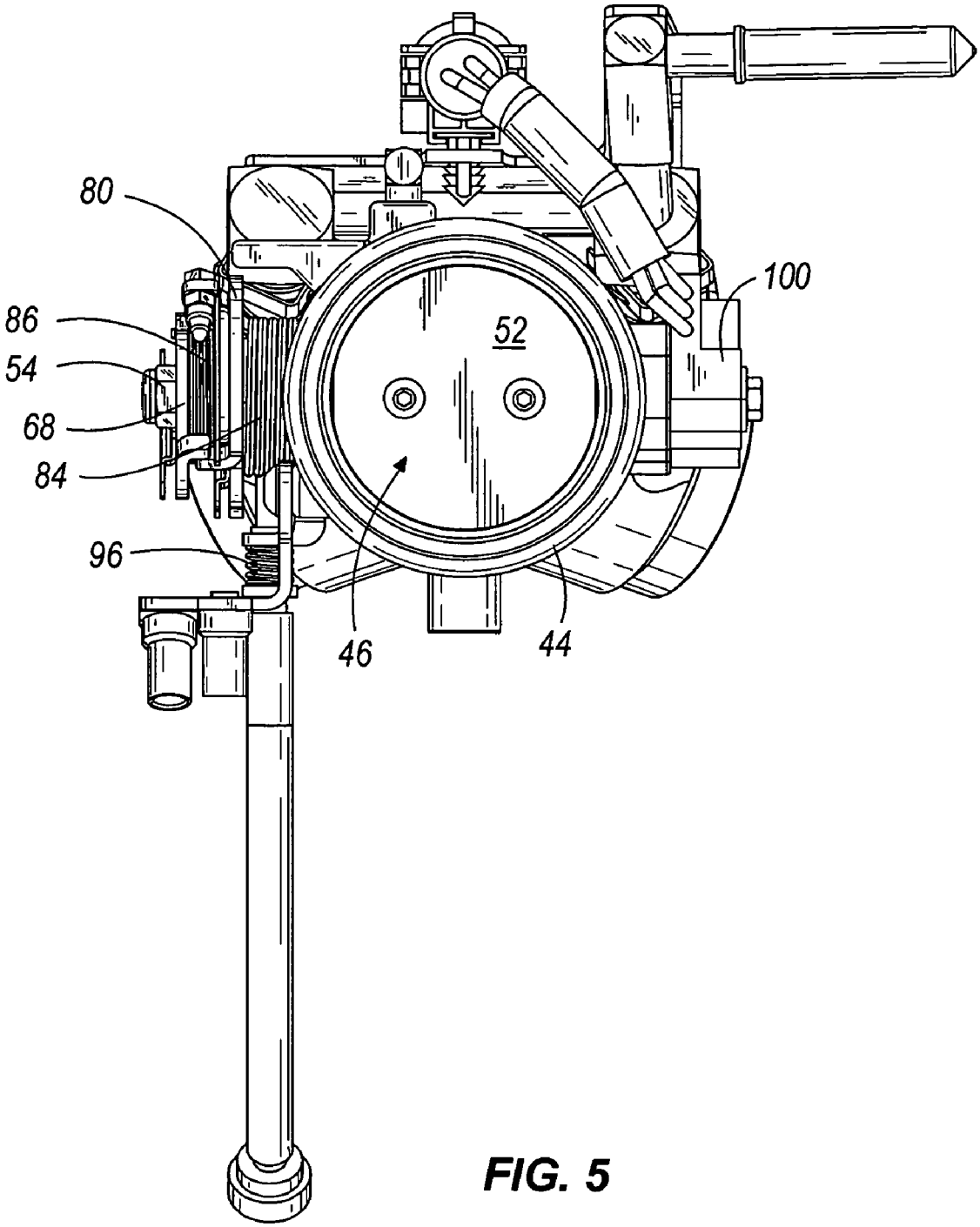
FIG. 5 is a top view of the portion of the intake power control shown in FIG. 3.
Figure 6:
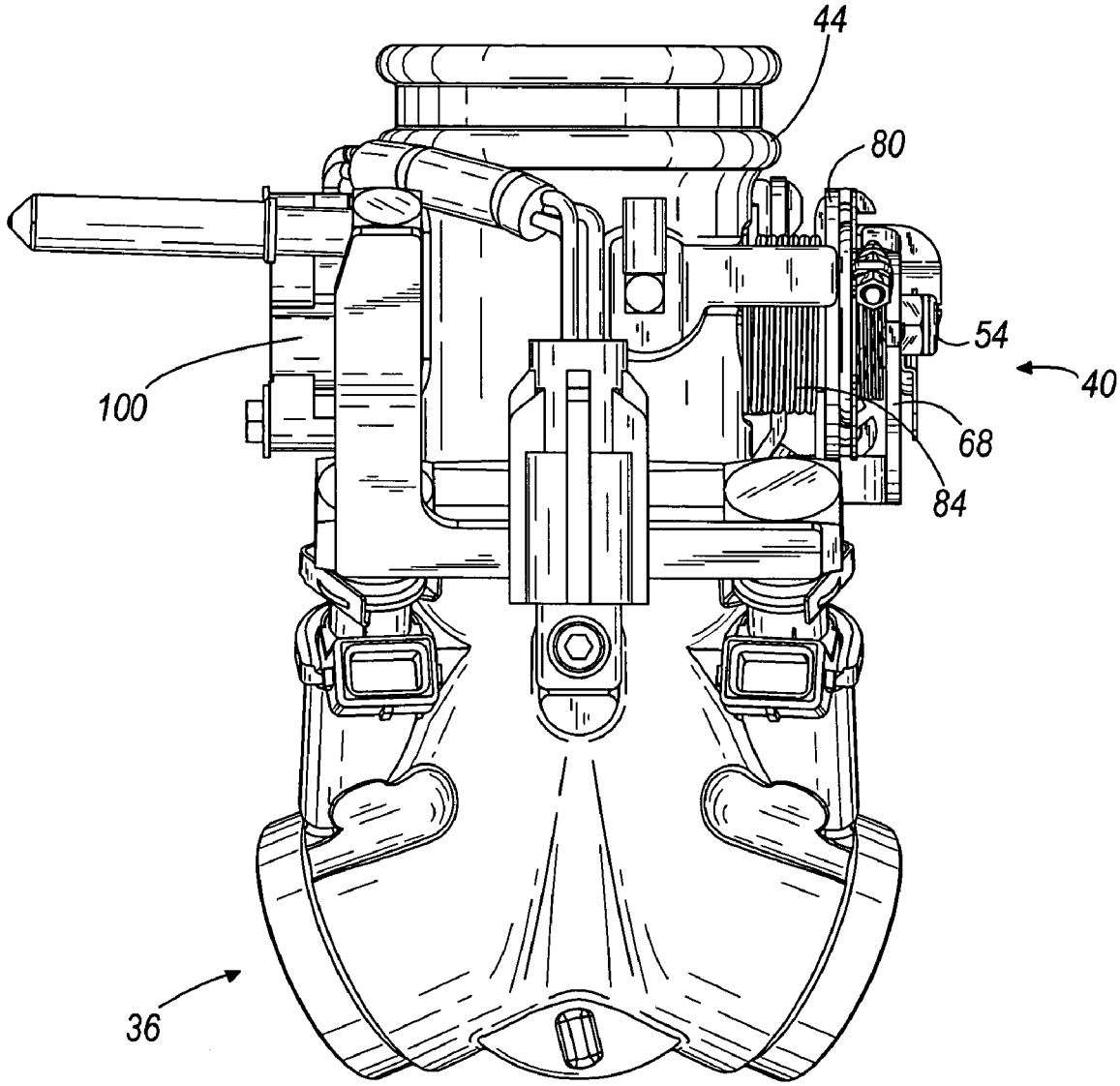
FIG. 6 is a side view of the portion of the intake power control shown in FIG. 3.

The valve 48 includes a throttle plate 52 (FIGS. 5, 9, and 10) coupled to a shaft 54. The shaft 54 is rotatable with respect to the throttle body 44 to change the orientation of the throttle plate 52 relative to the air passage 46 of the throttle body 44. The ends 55, 56 of the shaft extend through the throttle body 44. The first end 55 of the shaft 54 is biased to orient the plate in the position shown in FIGS. 9 and 10. In this position, relatively little air is allowed to pass through the throttle body 44, which defines the idle position. The shaft 54 can be rotated against the bias force to change the orientation of the plate 52 with respect to the air passage 46.

A pair of actuators 60, 64 are coupled to the first end 55 of the shaft 54. The actuators 60, 64 can rotate the shaft 54 to change the orientation of the plate 52 within the air passage 46. The first actuator 60 includes a first cable wheel 68 directly coupled to the shaft 54. Due to this configuration, rotation of the first cable wheel 68 will directly change the orientation of the plate 52 within the air passage 46. A cable 70 is connected to the first cable wheel 68 and extends to an electronic actuation device 72. The electronic actuation device 72 can apply a force to the cable 70, which will then apply a force to the first cable wheel 68 to cause rotation of the shaft 54. The illustrated electronic actuation device 72 is a solenoid. However, in other embodiments, the electronic actuation device 72 can include electric motors and other prime movers. As explained in greater detail below, the solenoid is coupled to an engine control module 76, which causes the solenoid to actuate.

The second actuator 64 includes a second cable wheel 80, a manual actuation device or hand throttle 81, and a pair of cables 82, 83 extending between the hand throttle 81 and the second cable wheel 80. The hand throttle 81 can be actuated in two directions. Rotation of the hand throttle 81 in a first direction causes a pulling force on a first cable 82, which causes the second cable wheel 80 to rotate in first direction. Upon release of the hand throttle 81, a bias force from a spring 84 extending between the second cable wheel 80 and the throttle body 44 will cause both the second cable wheel 80 and the hand throttle 81 to return to the idle position. However, the hand throttle 81 can also be rotated in a second direction opposite the first direction to cause a pulling force on the second cable 83, which causes the second cable wheel 80 to rotate in a second direction opposite the first direction. Rotation of the hand throttle 81 and second cable wheel 80 cause a change in orientation of the throttle plate 52 relative to the air passage 46 as discussed below.

As illustrated in FIGS. 9 and 10, the second cable wheel 80 is indirectly coupled to the shaft 54. The second cable wheel 80 is mounted on a projection 85 of the throttle body 44 that houses the first end 55 of the shaft 54. As such, the second cable wheel 80 is substantially concentric with the first cable wheel 68 and the shaft 54. The second cable wheel 80 is coupled to the first cable wheel 68 via a first torsion spring 86. The first torsion spring 86 is pretensioned prior to being connected to the first and second cable wheels 68, 80. Due to the pretensioning of the first torsion spring 86, rotation of the second cable wheel 80 will generally cause direct rotation of the first cable wheel 68 in a 1:1 ratio. In other words, the first cable wheel 68 will generally rotate one degree for every one degree the second cable wheel 80 rotates. As discussed in greater detail below, one situation in which the first and second cable wheels 68, 80 will not rotate the same amount is when the first cable wheel 68 is independently actuated by the electronic actuation device 72. During simultaneous rotation, the electronic actuation device 72 is in a neutral state allowing the cable 70 to move with the wheel 68 without resistance or with minimal resistance when wheel 68 is rotated in the acceleration direction and without creating slack when the wheel 68 is rotated toward the idle position.

Figure 7A:
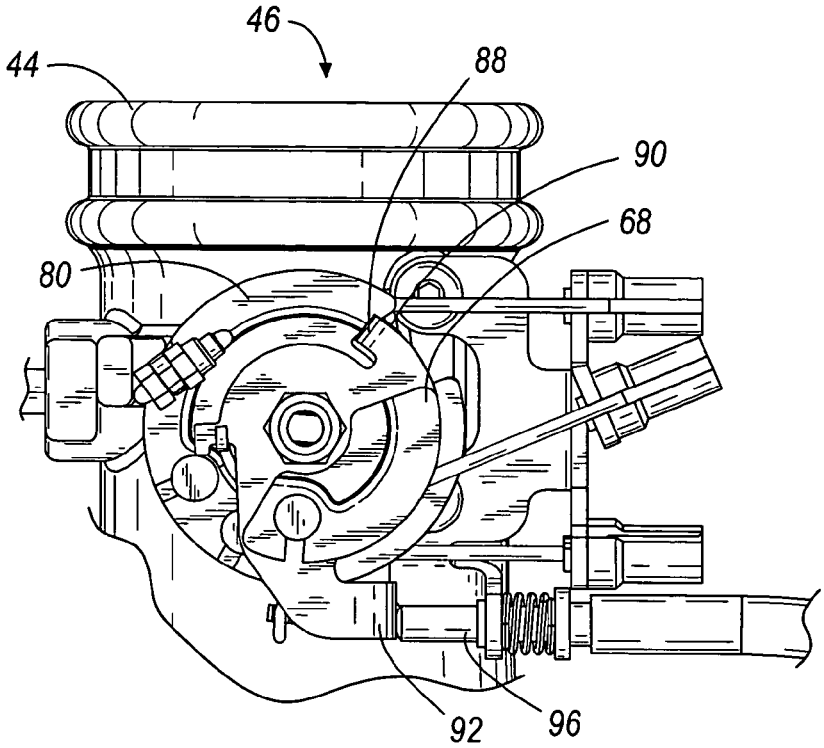
FIG. 7A is a partial side view of a first cable wheel and a second cable wheel of the intake power control illustrated in FIG. 2. The first and second cable wheels are in an at rest, idle position.
Figure 7B:
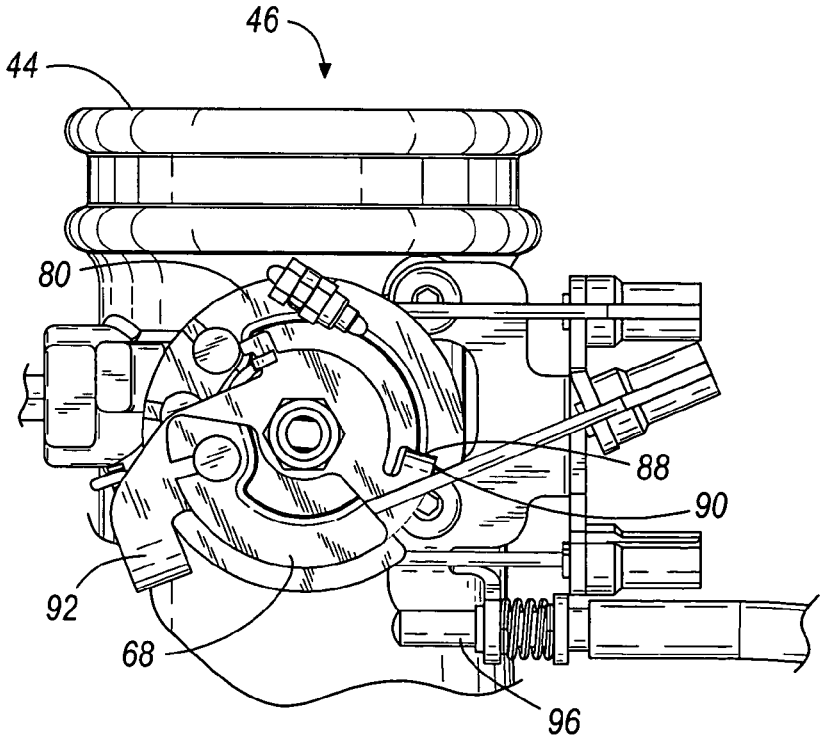
FIG. 7B is a partial side view of the first cable wheel and the second cable wheel illustrated in FIG. 7A where the first and second cable wheels are actuated in a clockwise direction relative to the position illustrated in FIG. 7A.
Figure 7C:
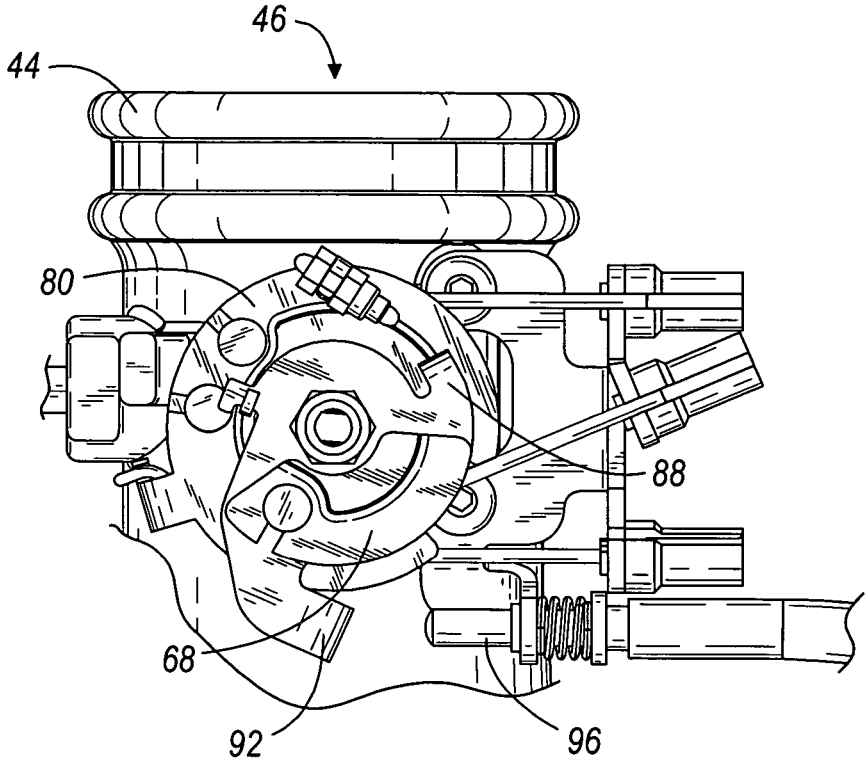
FIG. 7C is a partial side view of the first cable wheel and the second cable wheel illustrated in FIG. 7A where the first cable wheel is shown in the same position as FIG. 7B and the second cable wheel is actuated in a counter-clockwise direction relative to the position illustrated in FIG. 7B.
Figure 8:
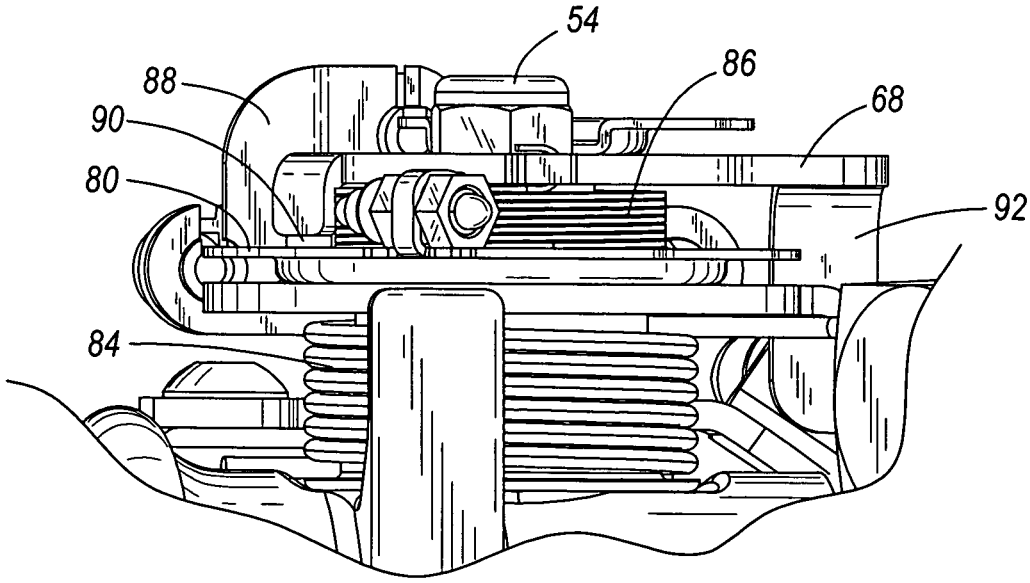
FIG. 8 is a partial top view of the first and second cable wheels illustrated in FIGS. 7A–C.

As best illustrated in FIG. 8, the first and second cable wheels 68, 80 generally lay in different planes. However, a portion of each wheel 68, 80 is positioned to engage the other wheel 68, 80 to limit relative movement of the cable wheels 68, 80 in one direction with respect to each other. Specifically, as illustrated in FIGS. 7A–C, a first projection 88 is positioned on the first cable wheel 68 and extends toward the second cable wheel 80. The second cable wheel 80 has a second projection 90 that extends toward the first cable wheel 68. Due to the preloading on the first torsion spring 86, the first projection 88 engages and the second projection 90 in most operating conditions (FIGS. 7A and 7B), including the illustrated idle position shown in FIG. 7A. The engagement between the first and second projections 88, 90 maintain the preload in the first torsion spring 86.

A third projection 92 extends from the first cable wheel 80 to an idle setting device 96. The third projection 92 is positioned to engage the idle setting device 96 when the throttle plate 52 and first cable wheel 68 are in the idle position (FIG. 7A). Consequently, the engagement of the third projection 92 with the idle setting device 96 prevents rotation of the first cable wheel 68 in a direction that would further limit the air passage 46. Since the first cable wheel 68 is connected to the shaft 54, the engagement of the third projection 92 with the idle setting device 96 also prevents further rotation of the second cable wheel 80 in a direction that would further limit the air passage 46.

Upon rotation of the second cable wheel 80 in a direction to further open the air passage 46 (FIG. 7B, 7C), the third projection 92 is rotated away from the idle setting device 96 due to the connection between the first and second cable wheels 68, 80 discussed above. In this position, the first cable wheel 68 can be independently actuated via the electronic actuation device 72 in a direction toward the idle setting device 96 (FIG. 7C), which will cause the throttle plate 52 to rotate and reduce the air flow in the air passage 46.

The third projection 92 will engage the idle setting device 96 when the first cable wheel 68 and the throttle plate 52 have returned to the idle position. The engagement of the third projection 92 with the idle setting device 96 prevents the air passage 46 from being completely restricted by the independent actuation of the first cable wheel 68. The position of the idle setting device 96 is adjustable to change the idle position.

As illustrated in FIGS. 9 and 10, a position sensor 100 is coupled to the second end 56 of the shaft 54. The position sensor 100 senses the amount of rotation of the shaft 54 to determine the orientation of the plate 52 within the air passage 46. This information is then communicated to the engine control module 76, which uses the information to control fuel delivery among other things. For example, based upon the sensed rotational position of the shaft 54, the engine control module 76 can determine the airflow to the engine 18. As such, the engine control module 76 can direct the fuel injectors (not illustrated) to deliver the proper amount of fuel to the manifold 36 corresponding to the airflow to maintain optimal combustion conditions to prevent backfires and misfires.

The engine control module 76 also controls the electronic actuation device 72 of the first actuator 60. The engine control module 76 senses a variety of operational parameters, such as engine speed, motorcycle speed, throttle plate 52 position and the like. The engine control module 76 actuates the electronic actuation device 72 when several of the parameters are within a predetermined range. Upon actuation of the electronic actuation device 72, the first cable wheel 68 will rotate relative to the second cable wheel 80, as shown in FIG. 7C, to cause the throttle plate 52 to restrict the air passage 46. This controls the power output of the engine 18. By using relative rotation of the first and second cable wheels 68, 80 to restrict the air passage 46 and control the power output, combustion remains at conditions optimal for combustion at all times. Specifically, by controlling the position of the throttle plate 52, both the airflow and the fuel delivery are controlled proportionately. In addition, by controlling the power of the output of the engine, traction of the rear wheel can be improved in slippery conditions.

The operation of the illustrated power control will now be described beginning with the motorcycle 10 idling. When the motorcycle is idling, the throttle plate 52 and the first and second cable wheels 68, 80 are in the idle position, as shown in FIGS. 7A, 9, and 10. Upon actuation of the hand throttle 81, the second cable wheel 80 rotates in a clockwise direction as viewed in FIGS. 7A and B. Rotation of the second cable wheel 80 causes the first cable wheel 68 to rotate substantially the same amount via a force transferred by the torsion spring 82. Since the first cable wheel 68 is directly coupled to the shaft 54, rotation of the first cable wheel 68 then causes the shaft 54 to rotate and change the orientation of the throttle plate 52 relative to the air passage 46. This allows more air to pass through the passage 46 and the power output of the engine 18 to increase. From this new position, the second cable wheel 80 can be rotated in the opposite direction (counter-clockwise relative to FIGS. 7A–C), which will cause the first cable wheel 68 to also rotate substantially the same amount in the opposite direction to again change the orientation of the throttle plate 52. During the counter-clockwise rotation, the power of the engine 18 is reduced as the throttle plate 52 restricts the air passage 46. Specifically, this provides less air for combustion.

As previously indicated, the engine control module 76 continuously receives information regarding a variety of operation parameters of the motorcycle 10, such as vehicle speed, engine speed, throttle position, and the like. These parameters are evaluated to determine whether they fall within a predetermined range defining a triggering event. One or more triggering events can be programmed into the engine control module 76. For example, in one embodiment the triggering event occurs when the motorcycle is travelling at about thirty miles-per-hour and the engine is operating at a corresponding speed indicating the motorcycle is traveling at a constant speed (i.e., with little acceleration, if any). In addition to the two parameters, the sensed throttle plate 52 position must indicate an intent by the rider to substantially accelerate the motorcycle 10 (e.g., movement of the throttle plate 52 from a position corresponding to traveling at nearly a constant speed of about thirty miles-per-hour to a nearly fully open position). Upon sensing these three conditions, the engine control module 76 will quickly override the user input via the hand throttle 81 to cause a more controlled and gradual acceleration of the motorcycle 10. Specifically, the engine control module 76 moves the throttle plate 52 to a position that reduces the power output of the engine 18 by restricting air flow to the engine 18, but yet allowing the motorcycle 10 to accelerate.

During an override, the engine control module 76 will actuate the electronic actuation device 72, which will cause the first cable wheel 68 to rotate in a counter-clockwise direction relative to the second cable wheel 80 as illustrated in FIG. 7C. When the engine control module 76 overrides the user input, the first cable wheel 68 actuates independent of the second cable wheel 80. The counter-clockwise rotation of the first cable wheel 68 causes the throttle plate 52 to rotate from the fully open position (or some other position) to a position that further restricts the air passage 46, but yet allows acceleration. Thus, the engine control module 76 allows the operator to reach a desired traveling speed while controlling the acceleration by controlling the power output of the engine 10.

Once one or more of the sensed parameters fall outside of the predetermined range, the engine control module 76 will no longer override the user input. Rather, engine control module 76 will return control of the throttle plate 52 to the user. Although control can be transferred to the user very quickly by actuating the solenoid to the non-override position, the engine control module 76 of the illustrated embodiment transfers control back to the user gradually. A very quick transfer could cause a sudden increase of power. Thus, in the illustrated embodiment, the solenoid is pulse width modulated from the override position to the non-override position. This causes a gradual increase of power.

The engine control module 76 can temporarily override the user's input for a variety of reasons. For example, as just described, the engine control module 76 can control the acceleration of the motorcycle 10 in predetermined situations. This can help the rider maintain better control over the motorcycle 10. In some situations, depending upon the horsepower and torque of a motorcycle engine, sudden acceleration can cause the front wheel of the motorcycle to leave the ground. The engine control module 76 can be programmed to improve the traction of the rear wheel with the ground during acceleration.

Additionally, the engine control module 76 can reduce the noise emissions of the motorcycle. By controlling the power of the motorcycle 10 with the throttle plate 52, the noise emitted from the motorcycle 10 is also controlled. Conventional power control techniques by cutting off fuel to the engine 18 or cutting of the spark. These techniques, unlike the present invention, caused greater noise emissions in some circumstances due to backfires and misfired caused by lean running conditions. Specifically, the lean running conditions occur when the air-to-fuel ratio is not optimal. In the present invention, combustion occurs with an optimal air-to-fuel ratio even when the engine control module 76 overrides the user's input to reduce the power. As indicated above, the amount of fuel delivered is dependent upon the sensed position of the throttle plate 52. As such, when the engine control module 76 reduces the power of the engine by moving the throttle plate 52, the fuel delivery is also altered corresponding to the sensed position of the throttle plate 52. Consequently, the engine 18 does not run lean and does not backfire or misfire.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

We claim:

1. An intake power control comprising:

a throttle body defining an air passage;

a throttle plate positioned within the air passage, the throttle plate movable between an idle position in which a first amount of air is allowed to pass through the air passage and a second position in which more air is allowed to pass through the air passage;

an electrically operable actuator coupled to the plate, movement of the electrically operable actuator directly causing movement of the plate; and a manually operable actuator coupled to the electrically operable actuator, movement of the manually operable actuator selectively causing movement of the electrically operable actuator;

wherein the manually operable actuator is coupled to a projection on the throttle body.

2. The intake power control of claim 1, further comprising a shaft extending across the air passage and pivotal within the air passage, a first end of the shaft extending through the throttle body, wherein the throttle plate is coupled to the shaft and rotatable with the shaft.

3. The intake power control of claim 2, wherein the electrically operable actuator comprises:

a first cable wheel coupled to the first end of the shaft, a first cable coupled to the first cable wheel, and an electrically powered actuation device coupled to the first cable, wherein actuation of the electrically powered actuation device moves the first cable wheel with respect to the manually operable actuator.

4. The intake power control of claim 3, wherein the electrically powered actuation device is a solenoid.

5. The intake power control of claim 4, wherein the solenoid is actuated in two directions, the solenoid actuated in at least one direction by pulse width modulation.

6. The intake power control of claim 3, wherein the manually operable actuator comprises:

a second cable wheel coupled to the throttle body and positioned around the shaft;

a second cable coupled to the second cable wheel; and a manually operable member coupled to the second cable.

7. The intake power control of claim 2, further comprising a torsion spring positioned around the first end of the shaft and having a first end coupled to the electrically operable actuator and a second end coupled to the manually operable actuator.

8. The intake power control of claim 2, further comprising a sensor positioned adjacent the second end of the shaft to determine the rotational position of the shaft.

9. The intake power control of claim 8, further comprising an electronic control module coupled to the sensor and the electrically operable actuator, the electronic control module selectively actuating the electrically operable actuator based upon sensed information.

10. The intake power control of claim 1, wherein the manually operable actuator is positioned between the electrically operable actuator and the throttle body.

11. The intake power control of claim 1, further comprising a stop positioned on the manually operable actuator, the stop engaging a portion of the electrically operable actuator to control movement of the electrically operable actuator with the manually operable actuator.

12. A motorcycle comprising:

an engine; and a throttle coupled to the engine, the throttle includes:

a throttle body defining an air passage;

a throttle plate positioned within the air passage, the throttle plate movable between an idle position in which a first amount of air is allowed to pass through the air passage and a second position in which more air is allowed to pass through the air passage;

an electrically powered actuation device;

an electrically operable actuator coupled to the plate and to the electrically powered actuation device, actuation of the electrically powered actuation device causing pivotal movement of the plate via the electrically operable actuator; and a manually operable actuator coupled to the electrically operable actuator and configured to move the throttle plate by rotating the electrically operable actuator without actuating the electrically powered actuation device, wherein the manually operable actuator and the electrically operable actuator are rotatable about a common axis.

13. The motorcycle of claim 12, wherein the throttle includes a shaft extending across the air passage and pivotal within the air passage, a first end of the shaft extending through the throttle body; a throttle plate coupled to the shaft and rotatable with the shaft.

14. The motorcycle of claim 13, wherein the common axis is coincident with the shaft.

15. The motorcycle of claim 13, wherein the electrically operable actuator comprises:

a first cable wheel coupled to the first end of the shaft, and a first cable coupled to the first cable wheel and coupled to the electrically powered actuation device, wherein actuation of the electrically powered actuation device moves the first cable wheel with respect to the manually operable actuator.

16. The motorcycle of claim 15, wherein the electrically powered actuation device is a solenoid.

17. The motorcycle of claim 16, wherein the solenoid is actuated in two directions, the solenoid actuated in at least one direction by pulse width modulation.

18. The motorcycle of claim 15, wherein the manually operable actuator comprises:

a second cable wheel coupled to the throttle body and positioned around the shaft;

a second cable coupled to the second cable wheel; and a manually operable member coupled to the second cable.

19. The motorcycle of claim 13, wherein the throttle includes a torsion spring positioned around the first end of the shaft and having a first end coupled to the electrically operable actuator and a second end coupled to the manually operable actuator.

20. The motorcycle of claim 13, wherein the throttle further comprises a sensor positioned adjacent the second end of the shaft to determine the rotational position of the shaft.

21. The motorcycle of claim 20, further comprising an electronic control module coupled to the sensor and the electrically operable actuator, the electronic control module selectively actuating the electrically operable actuator based upon sensed information.

22. The motorcycle of claim 12, wherein the manually operable actuator is positioned between the electrically operable actuator and the throttle body.

23. The motorcycle of claim 12, wherein the manually operable actuator is coupled to a projection on the throttle body.

24. The motorcycle of claim 12, wherein the manually operable actuator further comprises a stop positioned on the manually operable actuator, the stop engaging a portion of the electrically operable actuator to control movement of the electrically operable actuator with the manually operable actuator.

25. A method of controlling the power of a motorcycle engine, the engine having an air intake passage including a throttle plate coupled to a shaft and rotatable within the air passage with pivotal movement of the shaft, the throttle plate rotatable in a first direction to increase air introduced to the engine and rotatable in a second direction to reduce air introduced, a first actuator coupled to a first end of the shaft, a second actuator coupled to the first actuator, and an electrically powered actuation device connected to the first actuator, the method comprising:

operating the engine;

manually rotating the second actuator about a first axis to rotate the throttle plate in the first direction by rotating the first actuator without actuating the electrically powered actuation device;

increasing the air intake of the engine in response to moving the throttle plate in the first direction;

sensing a triggering condition; and rotating the first actuator relative to the second actuator about the first axis with the electrically powered actuation device in response to the triggering condition to thereby at least partially override the movement of the second actuator.

26. The method of claim 25, further comprising rotating the shaft and throttle plate in the second direction by moving the first actuator relative to the second actuator; and decreasing the air intake of the engine in response to moving the throttle plate in the second direction.

27. The method of claim 26, further comprising:

sensing a second triggering condition;

electronically moving the first actuator in response to the second triggering condition, the first actuator causing rotation of the shaft and throttle plate in the first direction without causing rotation of the second actuator; and increasing the air intake of the engine in response to moving the throttle plate in the second direction.

28. The method of claim 27, wherein electronically moving the first actuator comprises pulse width modulating the first actuator.

29. The method of claim 25, further comprising engaging a projection positioned on the first actuator with a stop positioned on the second actuator to limit the amount of rotation of the first actuator relative to the second actuator.

30. The method of claim 25, wherein the first axis is coincident with the shaft.

31. An intake power control comprising:

a throttle body defining an air passage;

a shaft extending across the air passage and pivotal within the air passage, a first end of the shaft extending through the throttle body;

a throttle plate coupled to the shaft and rotatable with the shaft within the air passage, the throttle plate rotatable in a first direction to increase an amount of air that is allowed to pass through the air passage and rotatable in a second direction to decrease the amount of air that is allowed to pass through the air passage;

a first cable wheel coupled to the end of the shaft, movement of the first cable wheel directly causing pivotal movement of the shaft;

a first cable coupled to the first cable wheel;

a solenoid coupled to the first cable;

a second cable wheel coupled to the throttle body and positioned around the shaft, movement of the second cable wheel selectively causing pivotal movement of the first actuator;

a second cable coupled to the second cable wheel; and a manually operable member coupled to the second cable; and a torsion spring having a first end coupled to the first cable wheel and a second end coupled to the second cable wheel.

* * * * *